US007273047B2

(12) United States Patent
Hu

(10) Patent No.: US 7,273,047 B2
(45) Date of Patent: Sep. 25, 2007

(54) ACTUATING MECHANISM OF AN AIR GUN

(76) Inventor: Shih-Che Hu, No.2, Lane 256, Yen Ho Street, Yung Kang City, Tainan Hsien (TW)

( * ) Notice: Subject to any disclaimer, the term of this patent is extended or adjusted under 35 U.S.C. 154(b) by 0 days.

(21) Appl. No.: 11/357,378

(22) Filed: Feb. 18, 2006

(65) Prior Publication Data

US 2007/0144507 A1 Jun. 28, 2007

(51) Int. Cl.
*F41B 11/32* (2006.01)

(52) U.S. Cl. ..... 124/74; 124/73

(58) Field of Classification Search ..... 124/71–76
See application file for complete search history.

(56) References Cited

U.S. PATENT DOCUMENTS 5,476,087 A * 12/1995 Kunimoto ..... 124/73
5,477,843 A * 12/1995 Kunimoto ..... 124/73
5,509,399 A * 4/1996 Poor ..... 124/76
5,664,552 A * 9/1997 Kunimoto ..... 124/73
6,073,620 A * 6/2000 Kunimoto ..... 124/74
6,112,734 A * 9/2000 Kunimoto ..... 124/73
6,497,229 B1 * 12/2002 Maeda ..... 124/76
6,564,788 B1 * 5/2003 Hu ..... 124/66
6,810,870 B1 * 11/2004 Hu ..... 124/76
2003/0084601 A1 * 5/2003 Kunimoto ..... 42/27
2005/0011508 A1 * 1/2005 Kunimoto ..... 124/73
2005/0064782 A1 * 3/2005 Kunimoto ..... 446/210

* cited by examiner

*Primary Examiner*—Troy Chambers
*Assistant Examiner*—Stewart T Knox
(74) *Attorney, Agent, or Firm*—Pro-Techtor Int'l Services

(57) ABSTRACT

An actuating mechanism used in an air gun is disclosed to include a hammer, a hook member hooked on the hammer for moving the hammer to the striking position, and a movable block supported on said spring member below a slide of the air gun. The movable block is turned to compress the spring member and to force a first stop edge thereof into engagement with a pivot in the air gun, and the hook member is forced to turn the hammer backwardly downwards to a hammering position when the user moved the slide to the rear side of the air gun. The hammer is disengaged from the hook member to strike the movable block, and the spring member returns the movable block to force a second stop edge of the movable into engagement with the pivot when the user triggered the air gun.

10 Claims, 11 Drawing Sheets

ACTUATING MECHANISM OF AN AIR GUN

BACKGROUND OF THE INVENTION

1. Field of the Invention

The present invention relates to an air gun and more specifically, to an actuating mechanism for air gun that has a simple structure that is easy to install and that saves much the manufacturing cost of the air gun.

2. Description of the Related Art

Various toy air guns have been disclosed and have appeared on the market. An air gun uses an actuating mechanism to control the output of a compressed gas to force out the bullet. FIGS. 1 and 2 show a toy air gun according to the prior art. According to this design, the actuating mechanism a' of the air gun comprises a holding down plate 10, a spacer plate 20, a right-side clamping plate 30, a driven block 40, a left-side clamping plate 50, a limiter plate 60, a hammer 70, an upper pivot 80, and a lower pivot 90. The holding down plate 10 has a bearing block 101 at the top side. The actuating mechanism a' is mounted in a holder frame e' near the rear side. The holder frame e' is mounted inside the gun body b' of the air gun, keeping the actuating mechanism a' shielded by a slide c' of the air gun. The upper pivot 80 is inserted through the holding down plate 10, the spacer plate 20, the right-side clamping plate 30, the driven block 40, the left-side clamping plate 50 and the limiter plate 60, having the two distal ends respectively fastened to the two opposite sidewalls of the holder frame e'. The lower pivot 90 is transversely fastened to the holder frame e' below the upper pivot 80. The hammer 70 is pivotally mounted in the rear side of the holder frame e', and turnable outwardly backwards to the outside of the air gun. Further, a pivot pin 401 is inserted through a torsional spring 402, an actuating block 403, the driven block 40 and a vertical rod 404. This structure of actuating mechanism a' is complicated.

When the slide c' is pulled to the rear side of the air gun, the a bearing block 101 of the holding down plate 10 and the limiter plate 60 are forced downwards, and the hammer 70 is forced to move the bell 701 thereof backwardly downwards and stopped by the vertical rod 404 in the hammering (triggering) position. When the user triggered the air gun, the vertical rod 404 is turned forwards and disengaged from the hammer 70, and the hammer 70 is returned to its former position.

The aforesaid actuating mechanism is complicated, resulting in a high manufacturing cost. Therefore, it is desirable to provide an actuating mechanism for air gun, which has a simple structure and is easy to install.

SUMMARY OF THE INVENTION

The present invention has been accomplished under the circumstances in view. It is the main object of the present invention to provide an actuating mechanism for air gun, which has a simple structure and is easy to install. It is another object of the present invention to provide an actuating mechanism for air gun, which greatly saves the manufacturing cost of the air gun.

To achieve these and other objects of the present invention, the actuating mechanism is installed in a mount inside the gun body of an air gun and covered by a slide. The actuating mechanism comprises a first pivot transversely mounted in the mount near a front side of the mount; a second pivot transversely mounted in the mount and spaced behind the first pivot at a distance; a hook member pivotally mounted on the second pivot inside the mount, the hook member having a hooked portion; a movable block pivotally mounted on the second pivot, the movable block having at least one through hole for the passing of the first pivot, a first stop edge and a second stop edge selectively forced into engagement with the first pivot, and a rear butt; a spring member stopped between the movable block and the second pivot; and a hammer pivoted to a rear side of the mount.

When the user moves the slide to a rear side of the gun body, the rear butt of the movable block is forced downwards by the slide, the movable block is moved to compress the spring member and to force the first stop edge into engagement with the second pivot, and the hook member is forced to turn the hammer backwardly downwards to a hammering position; when the user triggered the air gun, the hammer is disengaged from the hook member to strike the rear butt of the movable block, and the movable block is returned by the spring member to shift the first stop edge away from the first pivot and the second stop edge into engagement with the first pivot.

DETAILED DESCRIPTION OF THE PREFERRED EMBODIMENT

Figure 1:
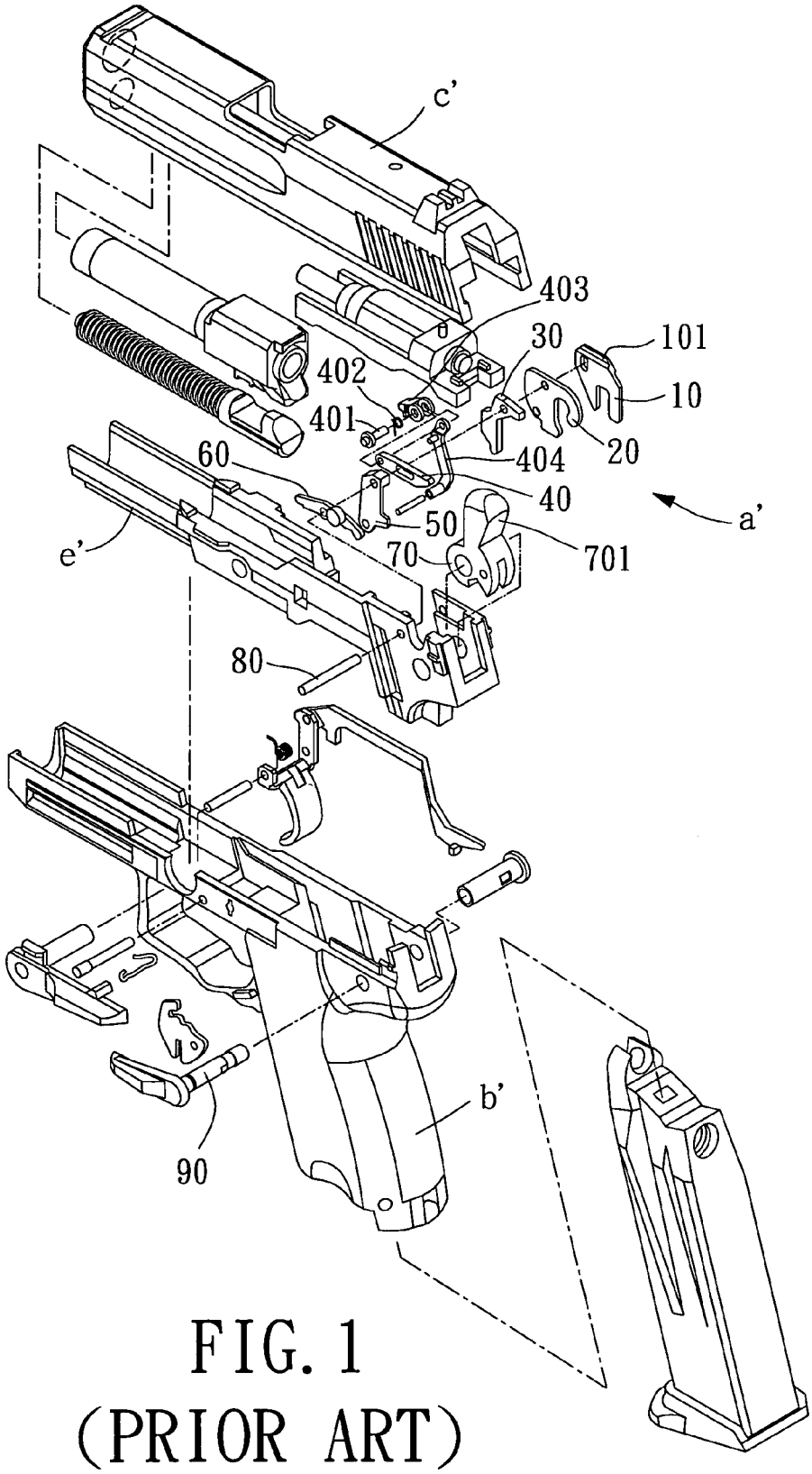
FIG. 1 (PRIOR ART)
FIG. 1 is an exploded view of an air gun according to the prior art.
Figure 2:
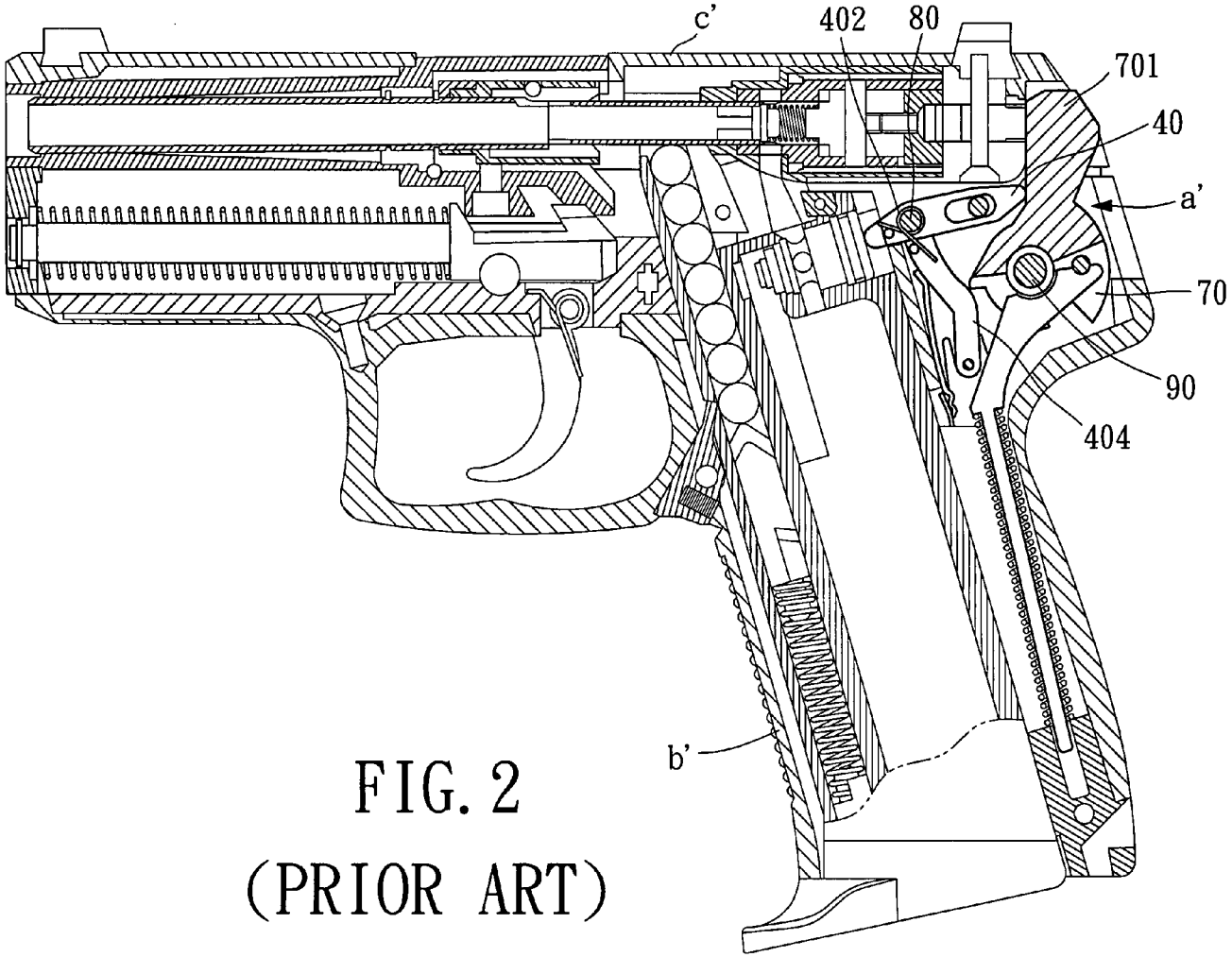
FIG. 2 (PRIOR ART)
FIG. 2 is an assembly plain view of the air gun according to the prior art.
Figure 3:
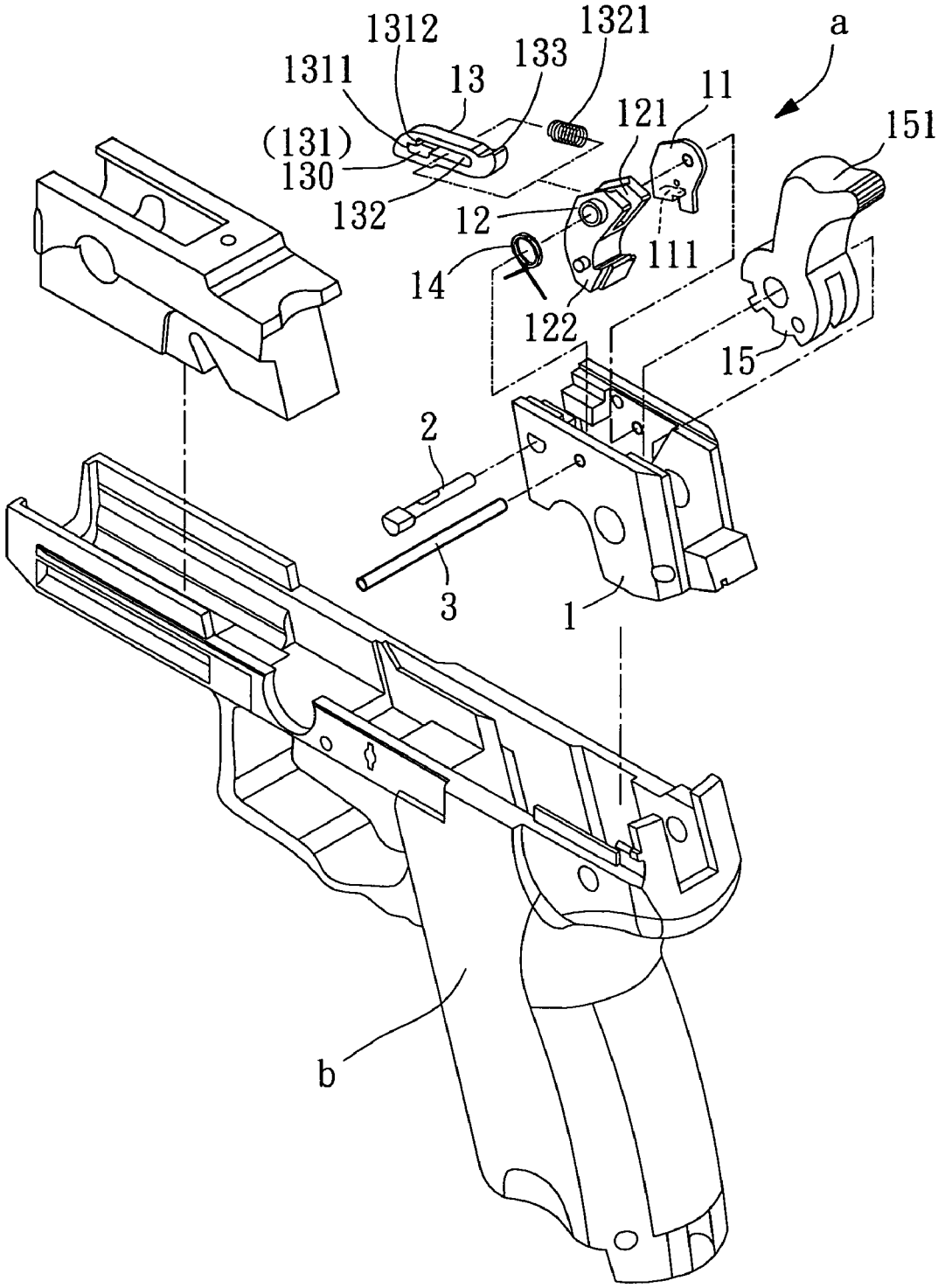
FIG. 3 is an exploded view of an air gun according to the present invention.
Figure 4:
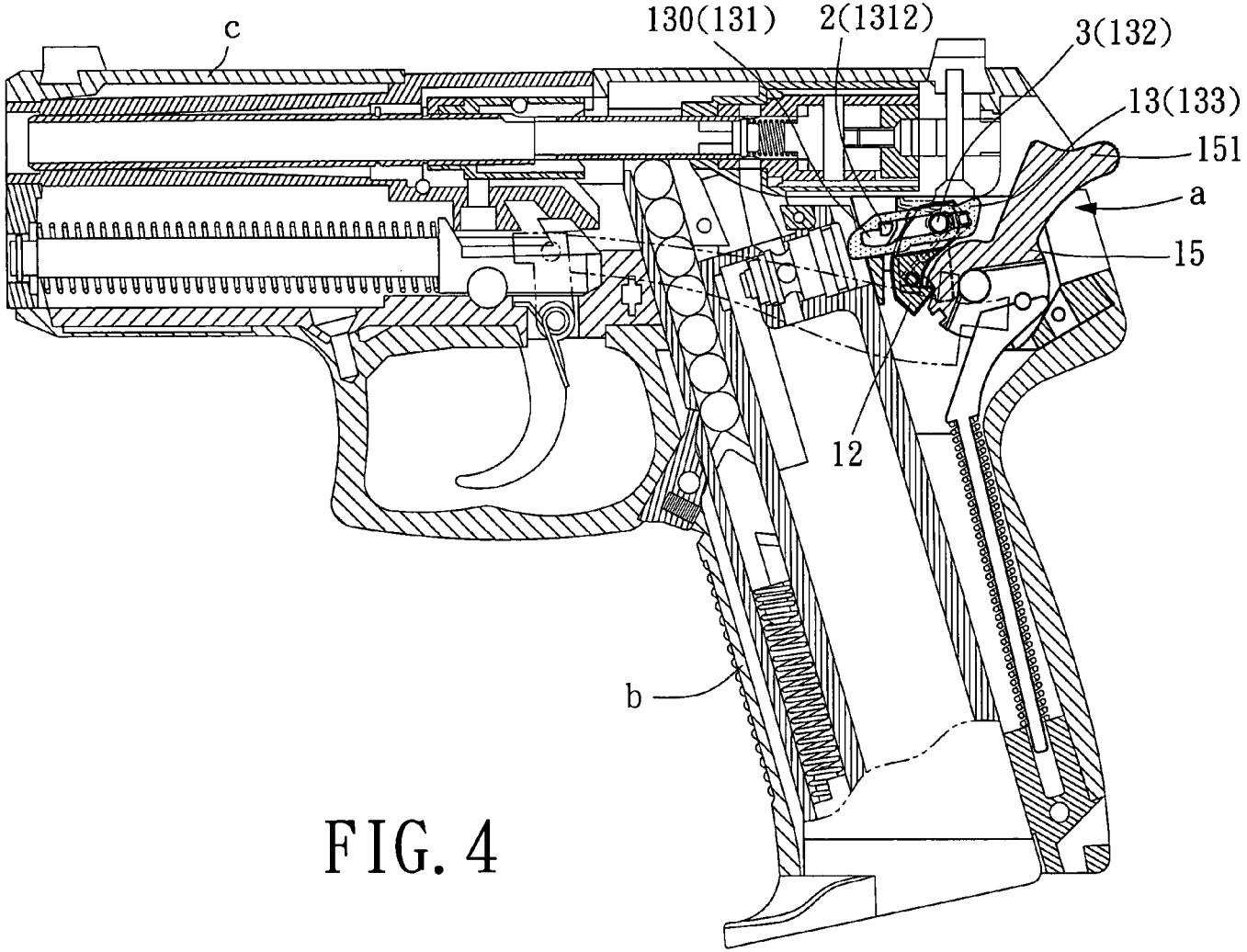
FIG. 4 is an assembly plain view of the air gun according to the present invention.
Figure 8:
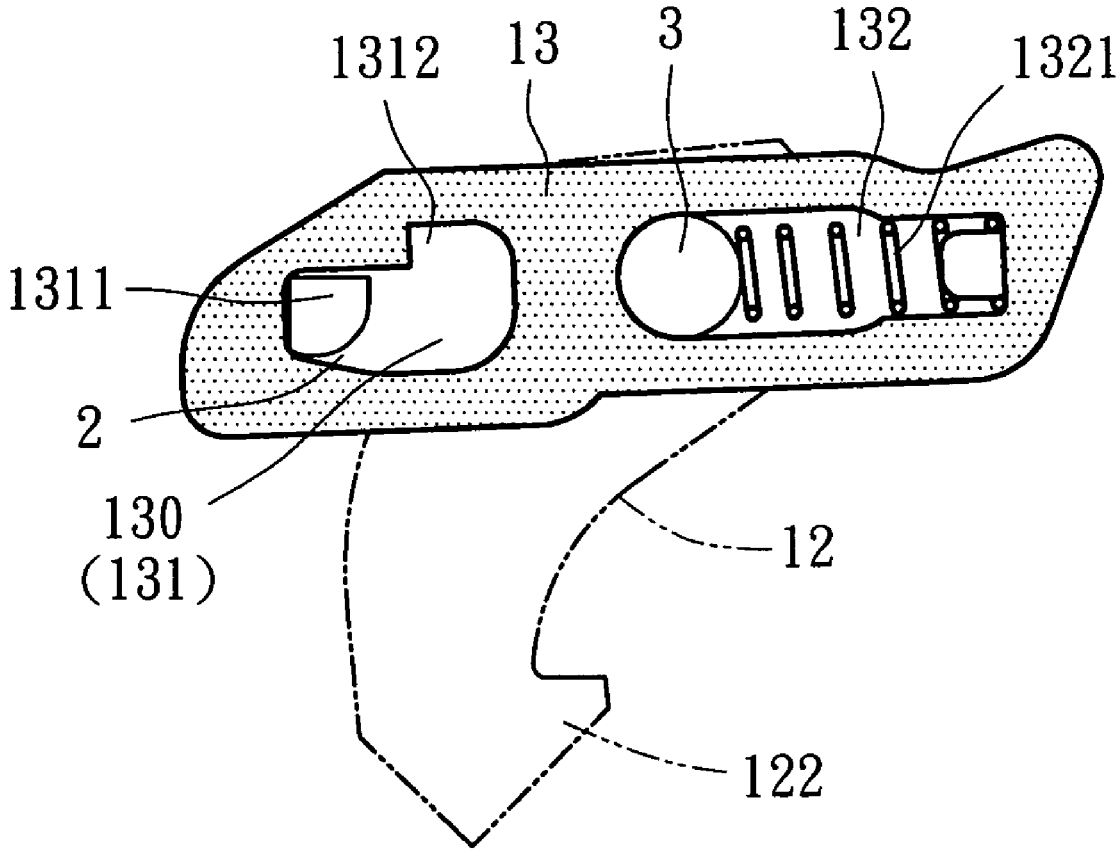
FIG. 8 is a schematic drawing showing an alternate form of the hook member according to the present invention.

Referring to FIG. 3, an actuating mechanism "a" is installed in a mount 1 at the rear end side of a gun body "b" and covered by a slide "c" (see FIG. 4). The actuating mechanism "a" comprises a clamping plate 11, a hook member 12, a movable block 13, a torsional spring 14, and a hammer 15. The hook member 12 has a top recess 121 at the top side thereof for accommodating the movable block 13 (see FIG. 3), and a bottom hooked portion 122 at the bottom side thereof. The movable block 13 has at least one through hole 130, and a rear butt 133. The at least one through hole 130 includes a front through hole 131 and a rear through hole 132. According to the embodiment shown in FIG. 3, the front through hole 131 and the rear through hole 132 are in communication with each other, thereby forming a sliding slot. According to the embodiment shown in FIG. 8, the front through hole 131 and the rear through hole 132 are two separated through holes. A front pivot 2 and a rear pivot 3 are respectively inserted through the front through hole 131 and rear through hole 132 of the movable block 13 and fastened to the mount 1 (see also FIG. 4A). The front through hole 132 is an elongated, step-like through hole having a first stop edge 1311 and a second stop edge 1312 behind and above the elevation of the front stop edge 1311. A spring member 1321 is mounted in the rear through hole 132 and stopped between the periphery of the rear pivot 3 and a part of the movable block 13, thereby imparting a backward pressure to the movable block 13. Therefore, the movable block 13 can be moved relative to the front and rear pivots 2 and 3 to let the first stop edge 1311 or second stop edge 1312 be selectively stopped against the front pivot 2. When the rear butt 133 of the movable block 13 received an upward pressure, the movable block 13 is moved to compress the spring member 1321, and the front pivot 2 is stopped at the second stop edge 1312 at this time. When the rear butt 133 of the movable block 13 received a downward pressure, the spring member 1321 returns the movable block 13 to shift the first stop edge 1311 into engagement with the front pivot 2.

Figure 7:
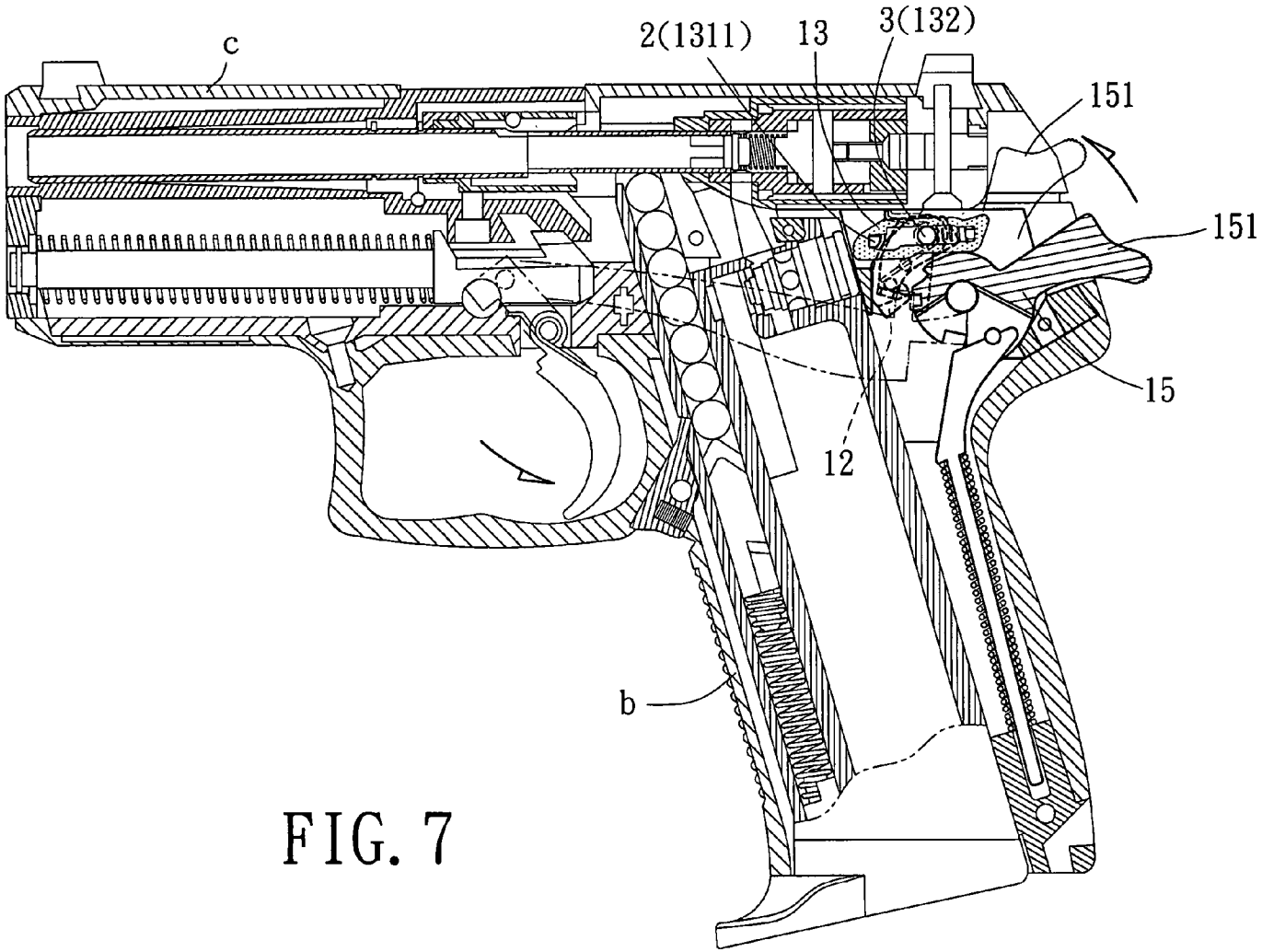
FIG. 7 is a schematic plain view showing the triggering action of the air gun according to the present invention.
Figure 7A:
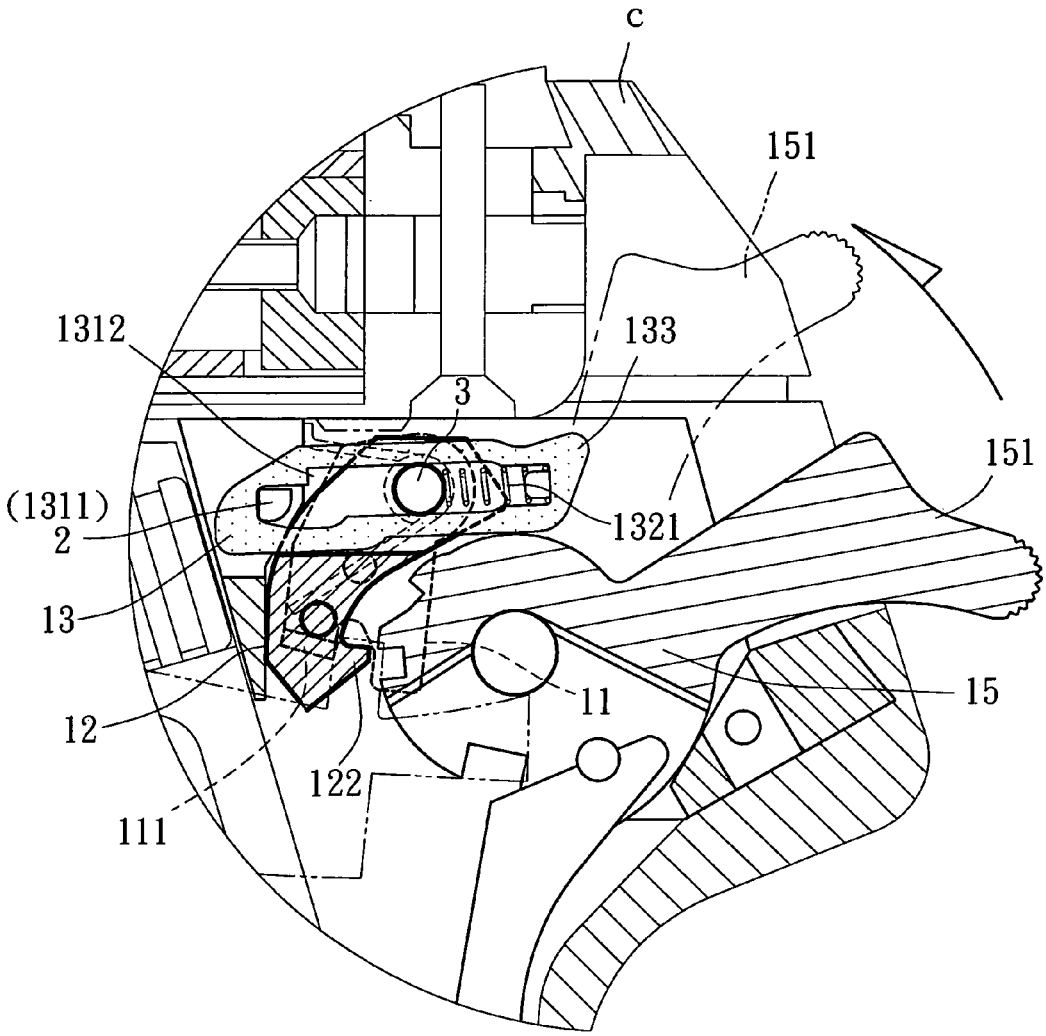
FIG. 7A is an enlarged view of a part of FIG. 7.

The front pivot 2 and the rear pivot 3 are respectively transversely mounted in the gun body "b". The rear pivot 3 also inserted through the clamping plate 11, the hook member 12, the rear through hole 132 of the movable block 13, and the torsional spring 14 (see FIG. 3). The clamping plate 11 has a protruding block 111. Upon each shooting action of the air gun, the protruding block 111 is forced to move the hook plate 12, causing disengagement of the hooked portion 122 of the hook member 12 from the hammer 15 (see also FIG. 7A). The hammer 15 is pivotally mounted in the rear side of the mount 1, having a bell 151 right behind the slide "c".

Figure 4A:
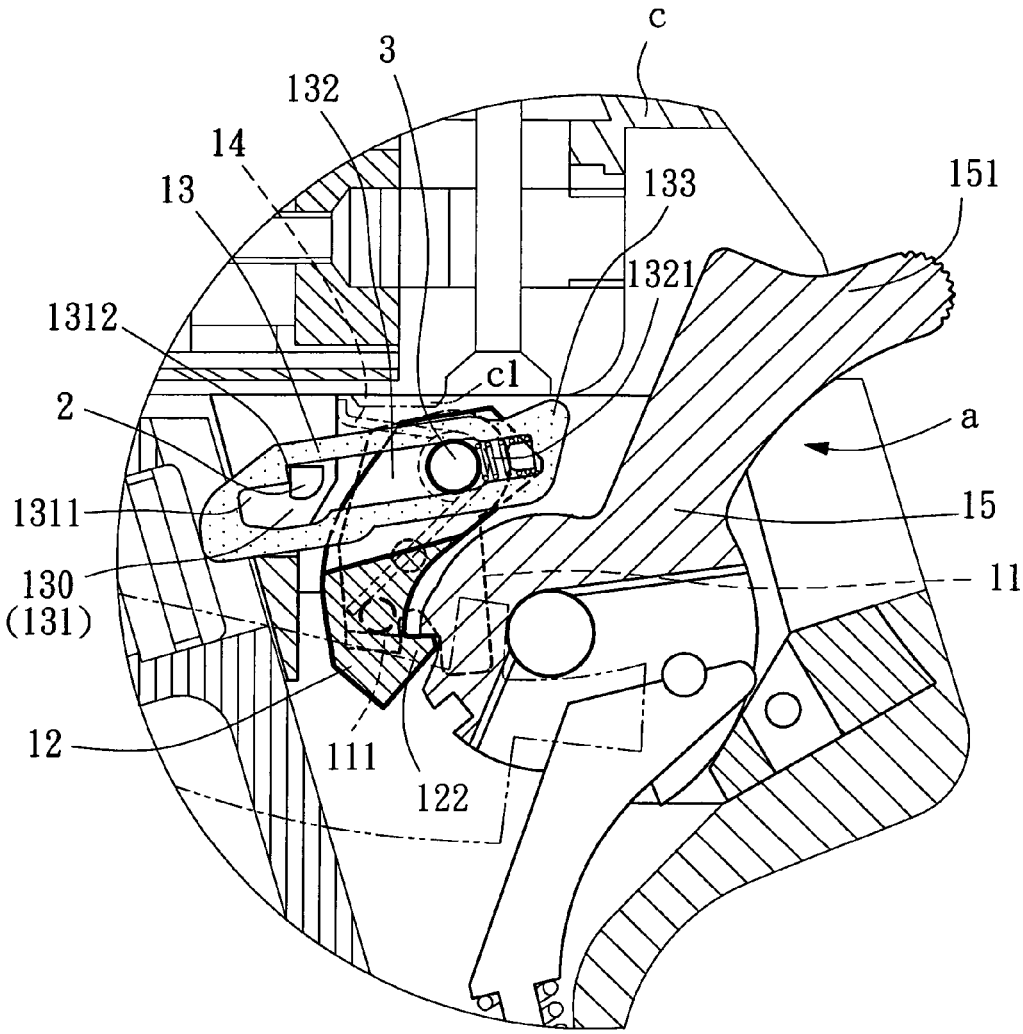
FIG. 4A is an enlarged view of a part of FIG. 4.
Figure 5:
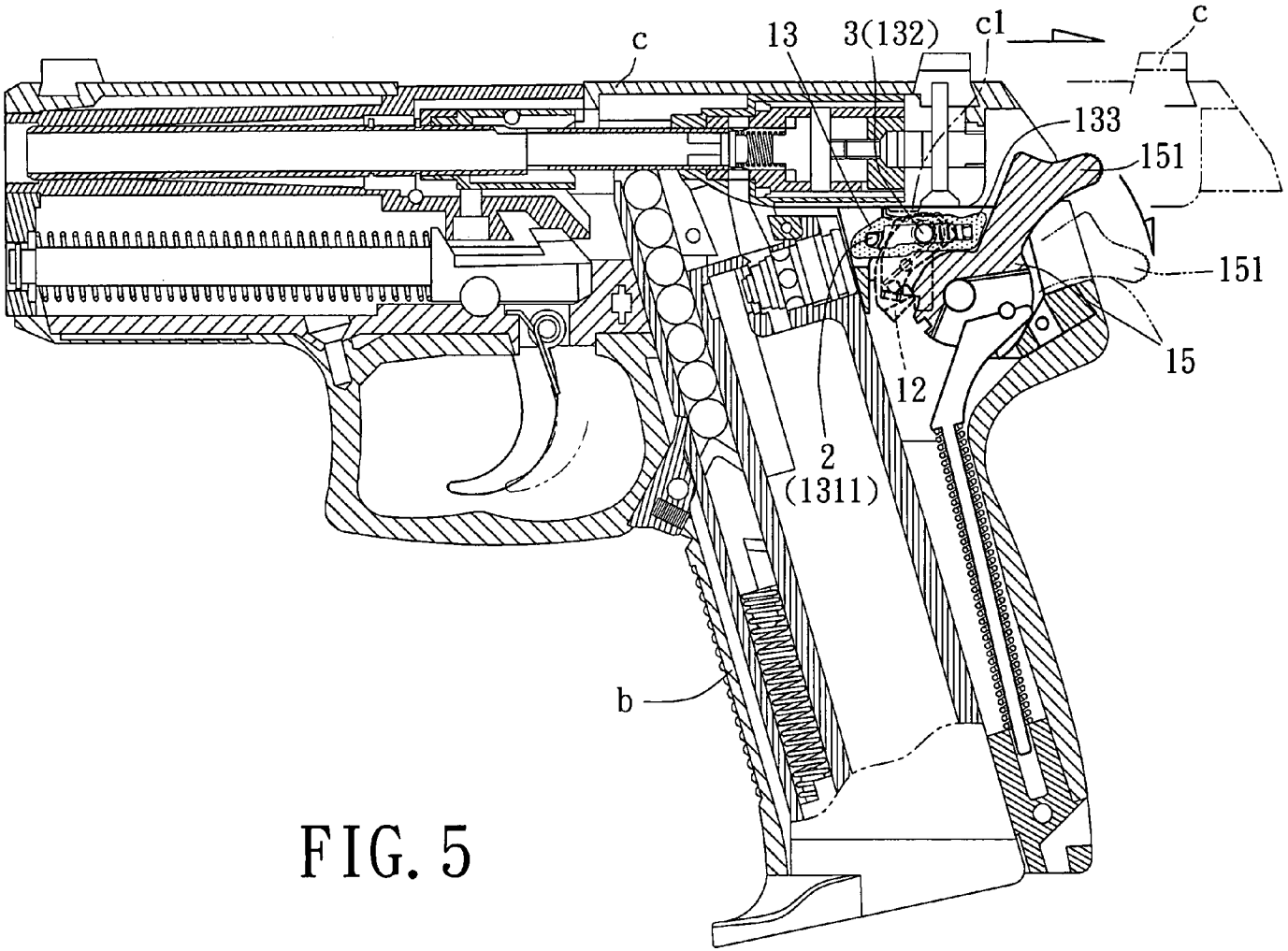
FIG. 5 is a schematic plain view of the present invention, showing the slide of the air gun shifted to the rear side.
Figure 5A:
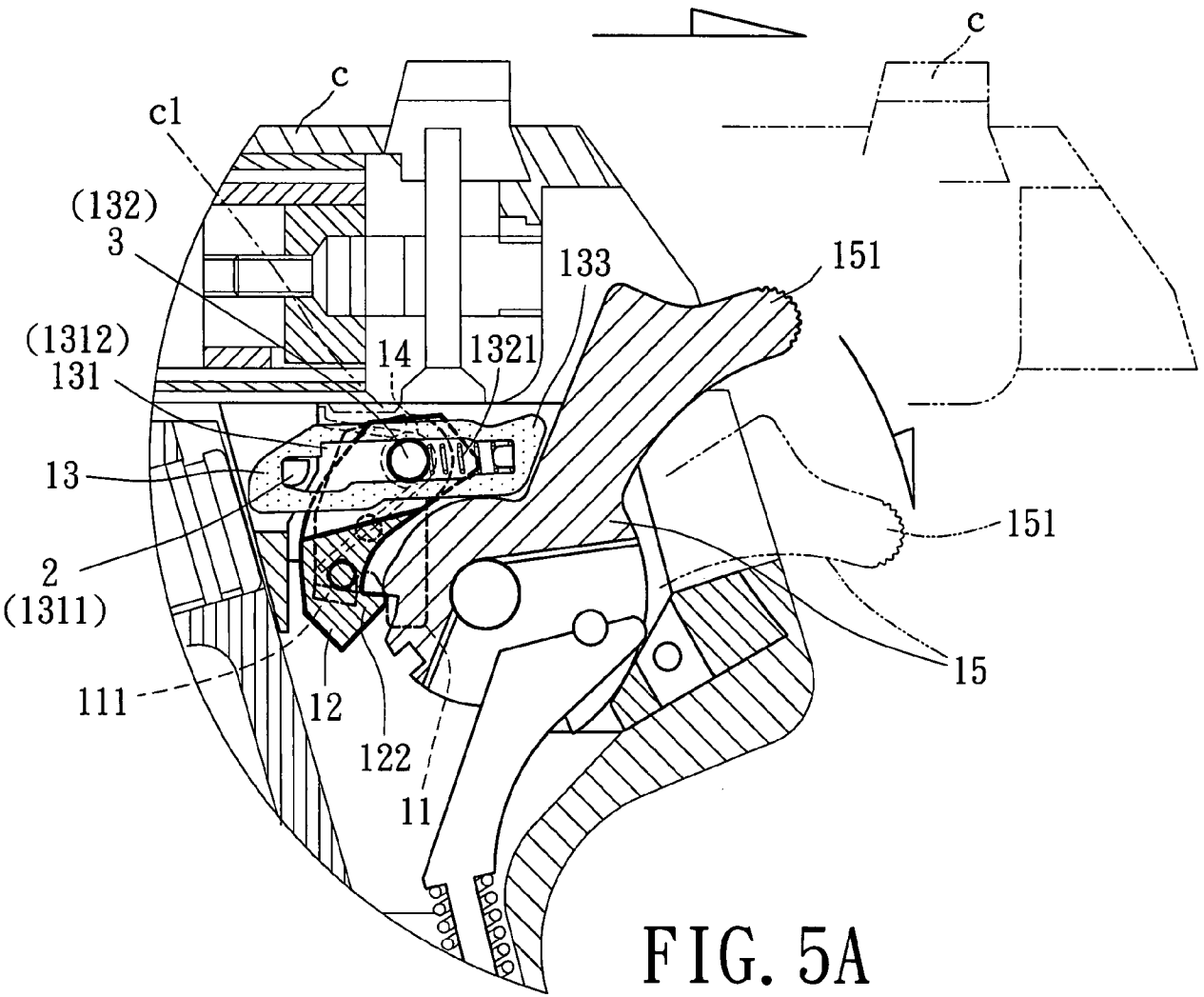
FIG. 5A is an enlarged view of a part of FIG. 5.
Figure 6:
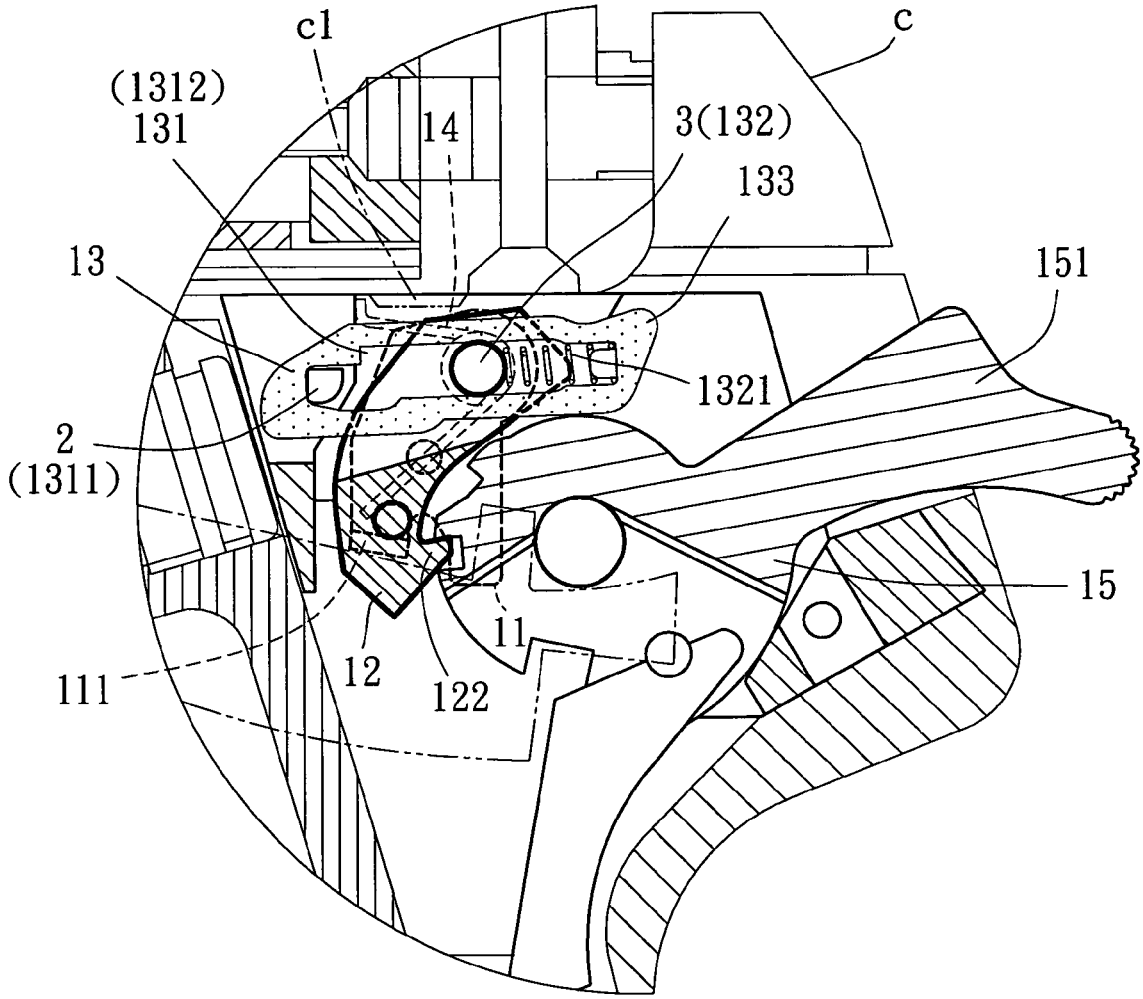
FIG. 6 corresponds to FIG. 5A, showing the hammer turned backwards.

After each shooting action of the air gun, the front pivot 2 is stopped at the second stop edge 1312 of the movable block 13 (see FIG. 4A). When the slide "c" is moved to the rear side for a next shooting (see FIG. 5), the rear butt 133 of the movable block 13 is forced downwards by the bottom protrusion c1 of the slide "c" (see FIG. 5A), thereby causing the movable block 13 to shift the second stop edge 1312 away from the front pivot 2 and the first stop edge 1311 into engagement with the front pivot 2. At this same time, the hammer 15 is turned backwardly downwards, keeping the bell 151 spaced apart from the slide "c" at a distance (see FIGS. 5A and 6). When the air gun is triggered again (see FIG. 7), the clamping plate 11 is forced to move the hook member 12, thereby disengaging the hooked portion 122 from the hammer 15. Immediately upon disengagement of the hooked portion 122 from the hammer 15, the hammer 15 is returned to the former position (because the return function of the hammer 15 is of the know art, no further detailed description in this regard is necessary), causing the bell 151 to strike the movable block 13, and therefore the movable block 13 is turned forwards to shift the second stop edge 1312 into engagement with the front pivot 2 and to further compress the spring member 1321 (see FIGS. 4 and 4A).

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An actuating mechanism installed in a mount inside a gun body of an air gun and covered by a slide of said air gun, the actuating mechanism comprising:

a hammer pivoted to a rear side of said mount;

a front pivot transversely mounted into said mount near a front side of said mount;

a rear pivot transversely mounted into said mount between said front pivot and said hammer, and spaced behind said front pivot at a distance;

a hook member pivotally mounted on said rear pivot inside said mount, said hook member having a rearwardly directed hooked portion engaging with said hammer;

a movable block mounted on said front pivot and said rear pivot, said movable block having a front longitudinally elongated through hole for the passing of said first pivot and a rear longitudinally elongated through hole for the passing of said rear pivot with a first stop edge and a second stop edge selectively forced into engagement with said front pivot and a rear butt contacting said hammer; and a spring member stopped between said movable block and said rear pivot;

wherein when the user moves said slide to a rear side of said gun body, said rear butt of said movable block is forced downwards by said slide, said movable block is moved to compress said spring member and to force said first stop edge into engagement with said front pivot, and said hook member is forced to turn said hammer backwardly downwards to a hammering position; when the user triggered said air gun, said hammer is disengaged from said hook member to strike said rear butt of said movable block, and said movable block is returned by said spring member to shift said first stop edge away from said front pivot and said second stop edge into engagement with said front pivot.

2. The actuating mechanism as claimed in claim 1, wherein said first stop edge and said second stop edge are respectively forced in said front through hole of said movable block at different elevations.

3. The actuating mechanism as claimed in claim 2, wherein said movable block is pivotally provided above said hook member.

4. The actuating mechanism as claimed in claim 3, wherein said hook member has a top recess adapted to accommodate said movable block.

5. The actuating mechanism as claimed in claim 2, wherein said spring member is mounted in said rear through hole of said movable block and stopped between a part of said movable block and a periphery of said rear pivot.

6. The actuating mechanism as claimed in claim 2, wherein said hook member has a bottom part forming said hooked portion.

7. The actuating mechanism as claimed in claim 2, further comprising a clamping plate pivotally mounted on said rear pivot and set between said hook member and said gun body, said clamping plate having a protruding block adapted to move said hook member away from said hammer each time the user triggers said air gun.

8. The actuating mechanism as claimed in claim 2, wherein when said front pivot is stopped at the second stop edge of said movable block, said spring member is compressed; when said rear butt of said movable block is forced downwards, said spring member is released to return said movable block.

9. The actuating mechanism as claimed in claim 2, wherein said front longitudinally elongated through hole of said movable block, which receives said front pivot and defines said first stop edge and said second stop edge, is in communication with said rear longitudinally elongated through hole, which receives said rear pivot, thereby forming a sliding slot encompassing both said front pivot and said rear pivot.

10. An actuating mechanism installed in a mount inside a gun body of an air gun and covered by a slide of said air gun, the actuating mechanism comprising:

a hammer pivoted to a rear side of said mount;

a front pivot transversely mounted into said mount near a front side of said mount;

a rear pivot transversely mounted into said mount between said front pivot and said hammer, and spaced behind said front pivot at a distance;

a hook member pivotally mounted on said rear pivot inside said mount, said hook member having a rearwardly directed hooked portion engaging with said hammer;

a movable block mounted on said front pivot and said rear pivot, said movable block having a front longitudinally elongated through hole for the passing of said first pivot and a rear longitudinally elongated through hole for the passing of said rear pivot, with a first stop edge and a second stop edge selectively forced into engagement with said front pivot, and a rear butt contacting said hammer; and a spring member stopped between said movable block and said rear pivot;

wherein when the user moves said slide to a rear side of said gun body, said rear butt of said movable block is forced downwards by said slide, said movable block is moved to compress said spring member and to force said first stop edge in to engagement with said front pivot, and said hook member is forced to turn said hammer backwardly downwards to a hammering position; when the user triggered said air gun, said hammer is disengaged from said hook member to strike said rear butt of said movable block, and said movable block is returned by said spring member to shift said first stop edge away from said front pivot and said second stop edge into engagement with said front pivot; and wherein said first stop edge and said second stop edge are respectively forced in said front through hole of said movable block at different elevations; and said movable block is pivotally provided above said hook member and said hook member has a top recess adapted to accommodate said movable block; and said spring member is mounted in said rear through hole of said movable block and stopped between a part of said movable block and a periphery of said rear pivot;

and said hook member has a bottom part forming said hooked portion;

further comprising a torsional spring mounted on said rear pivot and stopped between said gun body and a part of said hook member.

* * * * *